US005776648A

United States Patent [19]

Ikami et al.

[11] Patent Number: 5,776,648

[45] Date of Patent: Jul. 7, 1998

[54] ELECTROSTATIC LATENT IMAGE DEVELOPING METHOD

[75] Inventors: Jun Ikami, Nagoya; Kouji Inaishi, Okazaki, both of Japan

[73] Assignee: Brother Kogyo Kabushiki Kaisha, Nagoya, Japan

[21] Appl. No.: 635,686

[22] Filed: Apr. 22, 1996

[30] Foreign Application Priority Data

May 16, 1995 [JP] Japan ..... 7-116973

[51] Int. Cl.[6] ..... G03G 13/22

[52] U.S. Cl. ..... 430/120; 430/122; 430/124; 430/126

[58] Field of Search ..... 430/120, 122

[56] References Cited

U.S. PATENT DOCUMENTS 4,404,270 9/1983 Higashida et al. ..... 430/110
4,640,880 2/1987 Kawanishi et al. ..... 430/106.6

FOREIGN PATENT DOCUMENTS 60-22353 6/1985 Japan .

*Primary Examiner*—Roland Martin
*Attorney, Agent, or Firm*—Oliff & Berridge, PLC.

[57] ABSTRACT

An electrostatic latent image developing method using an electrostatic latent image developing apparatus to develop an electrostatic latent image, including providing the electrostatic latent image apparatus with an initial developing agent containing at least one carrier and toner containing at least one missing-middle-prevention agent, forming an electrostatic latent image on the photosensitive body, developing the electrostatic latent image on the photosensitive body by contacting the electrostatic latent image with the developing agent to produce a developed toner image, transferring the developed toner image formed on the photosensitive body to a recording medium, fixing the developed toner image to the recording medium, and supplying replacement toner to compensate for the toner consumed from the initial developing agent in developing the electrostatic latent image, wherein the replacement toner does not contain missing-middle-prevention agent.

10 Claims, 1 Drawing Sheet

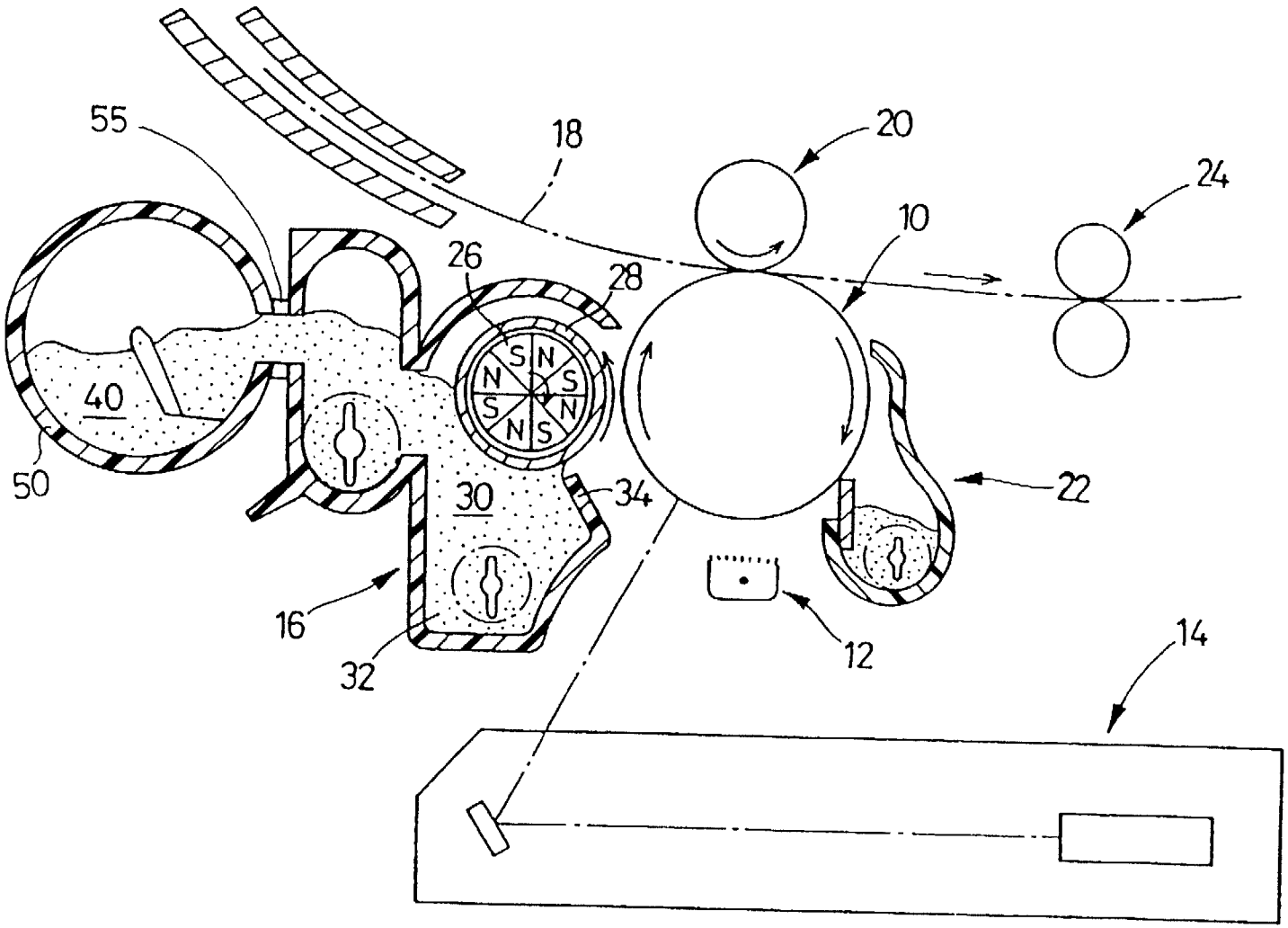
24
20
10
22
14
12
18
28
34
26
30
32
16
55
40
50
N
S

ELECTROSTATIC LATENT IMAGE DEVELOPING METHOD

BACKGROUND OF THE INVENTION

1. Field of the Invention

The present invention relates to a development method which reveals a latent image in an image forming device applied to electronic photographs and electrostatic recording equipment such as printers, facsimiles, copy machines, plotters and the like.

2. Description of Related Art

In general, electronic photograph developing methods may be classified roughly to a one-component developing system and a two-component developing system. The one-component developing system refers to a system in which developer is composed only of toner to be developed as an electrostatic latent image for a photosensitive body. The two-component developing system refers to a system in which the developer is composed of toner and a carrier which helps the toner to be efficiently charged. The developer used in the two-component developing system consists of a mixture in a percentage weight of 95–98% carrier and 2–5% toner.

If non-magnetic toner is used with a mixture ratio of more than or equal to 5%, toner fogging occurs in the non-print section, resulting in poor image quality. Hence a method is known in which magnetic toner is used and a mixture ratio of toner in the developer is increased, which is also referred to as a one and a half component developing system since the system falls in the middle of one-component developing system and a two-component developing system. This one and a half component system is disclosed in detail in U.S. Pat. No. 4,640,880 (Japanese Laid-Open Patent Publication Hei 2-31383). The one and a half component developing system composes developer with a mixture ratio of 30–80% carrier and 20–70% toner. With the two-component or one and a half component developing systems, a sleeve containing magnet rolls is used as a holder, on which a thick developer layer is formed.

With the developing system using magnetic toner, a method is known in which conductive material such as carbon black is mixed with the toner to give conductivity to the toner and the toner is guided to the electrostatic latent image on the photosensitive body by the effect of the electric field generated between the photosensitive body on which an electrostatic latent image is formed and the surface of the sleeve holding the toner. With this developing system, though it can be miniaturized because it does not require frictional charging of the toner, the efficiency of the toner transfer onto the recording medium is poor due to the absence of electrostatic power needed to transfer onto the recording medium in the toner which is developed on the photosensitive body, often causing the phenomenon known as a missing middle.

On the other hand, a system referred to as insulating developing system is known as a developing system using the same magnetic toner. In this system, the above-mentioned conductive material is not mixed in the toner but magnetic binding power and blackness are satisfied only with magnetic pigment. However, a binding resin mixed with magnetic powder has a higher volume resistance than the magnetic powder, and thus the volume resistance of the toner changes with the amount of magnetic powder contained in the toner, though the toner is an insulating magnetic toner.

In the case of an insulating magnetic toner, the amount of magnetic powder in the toner is controlled in order to satisfy both blackness and the magnetic binding power by the amount of the magnetic powder. However, even if an insulating magnetic toner is used, in some cases, the same missing middle phenomenon as in the case of conductive magnetic toner may occur in accomplishing the transfer to the recording medium, depending on the volume resistance or the transfer conditions of the toner.

However, in the case of insulating magnetic toner, the magnetic powder has the function of a pigment, and it is thus impossible to increase the volume resistance by making the amount of magnetic powder small in order to satisfy the blackness of the toner.

In addition to the method of increasing volume resistance, methods are known to resolve the missing middle phenomenon in which metallic soap such as zinc stearate, titanium dioxide, strontium oxide or strontium titanic acid is added to the toner. Among these methods, zinc stearate, which is a metallic soap, serves as a lubricant between the photosensitive body and the toner and improves the mold separability of the developed toner from the photosensitive body, thus tremendously improving the transfer efficiency and effectiveness in preventing the missing middle problem.

However, while metallic soap, titanium dioxide, strontium oxide or strontium titanic acid is added to the toner to prevent the missing middle problem, and the problem of the missing middle may be eliminated, the fog printing problem worsens. Hence, the number of printed pages satisfying the quality standard during a quality examination is reduced by at least half.

In other words, mixing of metallic soap, titanium dioxide, strontium oxide or strontium titanic acid with the toner increases the charge amount, and spreads the charge amount distribution of the toner, causing the reverse polarity of the toner to increase and the toner to attach to the part where the electrostatic latent image does not exist in the photosensitive body. If such a toner is not transferred to the recording medium, there is no problem. However, in actuality, the original characteristics of the missing-middle-prevention agent needed to efficiently transfer the toner from the photosensitive body are magnified and the toner is transferred to the non-printing part on the recording medium, resulting in increased fog printing.

SUMMARY OF THE INVENTION

In order to resolve these and other problems, the present invention describes a developing method which provides stable image quality through the function of a missing-middle-prevention agent, resulting in an increase in the number of quality print pages and in prevention of an increase in fog printing.

In order to achieve these and other objects, the developing method of the present invention uses toner to develop and reveal an electrostatic latent image formed on a photosensitive body. A missing-middle-prevention agent is added to the initial pre-filled toner, but the missing-middle-prevention agent is not added to the replacement toner in developing the electrostatic latent image on the photosensitive body.

Moreover, as the missing-middle-prevention agent at least one of metallic soap, titanium dioxide, strontium oxide or strontium titanic acid is preferably added to the toner.

In the developing method of the present invention, development of an electrostatic latent image is achieved by mixing the missing-middle-prevention agent with the initial toner but not with the replacement toner, which prevents an increase in the reverse polar toner generated by the spread of the charge amount distribution of the toner. Hence, the toner is not attached on the part of the photosensitive body where an electrostatic latent image does not exist. Thus, an increase in fog printing on the recording medium is prevented and a higher quality image is obtained. Moreover, the function of the missing-middle-prevention agent of separating the toner from the photosensitive body remains and thus the missing middle phenomenon is prevented.

BRIEF DESCRIPTION OF THE DRAWINGS

A preferred embodiment of the present invention is described in detail hereafter, with reference to the following FIGURE wherein:

The FIGURE is a drawing illustrating an example of a structure of the major section of a laser beam printer to which the developing method of the present invention can be applied.

DETAILED DESCRIPTION OF PREFERRED EMBODIMENTS

An electrostatic latent image developing agent used in the developing method of the present invention is applied to a printing method in which an electrostatic latent image is developed, such as an electronic photograph method, an electrostatic recording method and the like. The development principle will be described hereafter based on the FIGURE, showing a situation in which an electrostatic latent image developing agent is filled into a laser printer.

Here, in a preferred embodiment of the present invention, an one and a half component developing agent which comprises a mixture of the toner and the carrier is held in the surface of the sleeve 28 which contains a magnet roll 26. As explained above, the one and a half component developing system uses an electrostatic latent image developing agent comprising a mixture of magnetic toner and magnetic carrier to give a sufficient amount of friction charge to the toner by the function of the carrier.

The laser beam printer illustrated in the FIGURE comprises, around the photosensitive body 10 formed, for example, by coating a light conductive layer on an aluminum conductive cylindrical tube, a charger 12 which gives surface potential to the photosensitive body 10, a laser scanner 14 which illuminates the surface of the photosensitive body 10 by selectively flashing a semiconductor laser (not shown) to form an electrostatic latent image based on the image information on the photosensitive body 10, a developer 16 to develop the toner for electrostatic latent image on the photosensitive body 10, transfer equipment 20 to transfer the revealed image of the toner formed on the photosensitive body 10 to a recording medium 18 such as paper, a cleaning blade 22 to remove residue toner remains from the photosensitive body 10 without being transferred by the photosensitive body 10, and a heat fixer 24 which fixes the toner image transferred onto the recording medium 18 by means of heat fusion. Fixing of the image to the recording medium may also be accomplished by other suitable means such as pressure.

Moreover, with the developer 16, a non-magnetic sleeve 28 which holds electrostatic developing agent 30 is placed around the magnet roll 26 on which the N pole and S pole are placed alternatively in cylindrical form, and these poles are made to be able to rotate relatively in the reverse direction. The electrostatic latent image developing agent 30 is filled in the developer 16 and is stirred by an appropriate stirring means to make contact with the sleeve 28. In this instance, in order to transport the electrostatic latent image developing agent to the surface of the photosensitive body 10, at least the sleeve 28 needs to rotate, but the magnet roll 26 is not required to rotate and can be held stationary.

Moreover, the electrostatic latent image developing agent 30 is mixed in a carrier sealing chamber 32 in which such sleeve 28 is placed. The premixed electrostatic latent image developing agent 30 of the present invention, which is a mixture of at least the carrier and the toner containing the missing-middle-prevention agent as an additive is filled in the carrier sealing chamber 32, prior to the start of developing. Of these, the toner is transported to the photosensitive body 10 and is consumed during the revealing of the electrostatic latent image. Thus, the replacement toner 40, which does not contain the missing-middle-prevention agent, is supplied from the toner cartridge 50 which is connected to the carrier sealing chamber 32 via a toner supply opening 55 according to the amount consumed.

With such developer 16, a blade 34 is provided, at a predetermined interval from the sleeve 28, on which a layer of the electrostatic latent image developing agent 30 is formed. The interval between the sleeve 28 and the blade 34, in general, is arranged to be narrower than the interval between the photosensitive body 10 and the sleeve 28, which is normally, for example, 250–450 μm, to avoid affecting image quality. For example, if the interval between the photosensitive body 10 and the sleeve 28 is 350 μm, then the interval between the blade 34 and the sleeve 28 should be arranged to be between about 200 to 300 μm.

In the charger 12, a corona electric discharge takes place with an application of about 3–5 kV voltage and surface potential of about +700V is formed on the photosensitive body 10. Members such as a scorotron which provides a predetermined surface potential to the photosensitive body 10 by means of corona electric discharge, or a semiconductive brush, roller or blade which provides surface potential by making contact with the photosensitive body 10 may also be used as a charger 12.

Image information converted to the electric signals are supplied as light signals from the laser scanner 14 to the photosensitive body 10 to which surface potential is given by the charger 12. The surface potential of the part of the photosensitive body 10 which is exposed due to the function of the light conductive layer drops, which changes the potential distribution on the photosensitive body 10. In other words, the part where the potential drops becomes the electrostatic latent image corresponding to the image information.

The electrostatic latent image developing agent 30, which is transported by the sleeve 28 in the developer 16, forms a developing agent layer of predetermined thickness on the surface of such sleeve 28 by the function of the blade 34 and the developing agent layer contacts the photosensitive body 10 causing only the toner of the electrostatic latent image developing agent 30 to attach to the electrostatic latent image formed on the photosensitive body 10 to be developed. The carrier and the toner which are not developed are transported back to the carrier sealing chamber 32 to be used for friction charging of the toner. The electrostatic latent image on the photosensitive body 10 is formed under conditions such that the surface potential given by the charger 12 is preferably 700V and the potential of the part exposed due to the exposure of the laser scanner 14 drops below 100V. On the other hand, a preferred potential of 600V is given to the sleeve 28 as a bias potential, and the toner which is positively charged by the bias potential is developed on the part in the photosensitive body 10 where the potential is 100V. Here, the charge of the toner used in the present embodiment is a positive charge, but a negative charge can be applied if the potential given to each member is made to have reverse polarity.

The developed toner image thus formed on the photosensitive body 10 is transferred to the recording medium 18 such as paper using transfer equipment 20. Transfer to the recording medium can be direct as with a roll as illustrated in the FIGURE, or an intermediate transfer member such as known can be used in transferring the image. The toner is fixed on the recording medium 18 by, for example, heat fixer 24, producing a recording image targeted.

Next, the electrostatic latent image developing agent 30 which is used in the laser beam printer of the present embodiment will be described. The electrostatic latent image developing agent 30 comprises the magnetic carrier and the magnetic toner.

The raw material for the magnetic carrier may be composed of powder of iron, nickel, cobalt, ferrite, magnetite and the like as long as the powder is magnetic. The carrier may be produced for example by pre-baking and grinding the raw material with an appropriate mixture ratio to an average granule diameter of preferably no more than 2 μm, which is made into grains of predetermined size and sintered for 3–5 hours at a temperature of 1250°–1350° C., and finally by breaking or sorting the grains. The coercive force of the carrier thus produced is preferably no more than 5 Oe (oersted), and remnant magnetization is preferably no more than 5 emu/g. Only a carrier with flux saturated density in the range of 80– 100 emu/g is usable. The smaller the diameter of the grain of the carrier, the more chance the carrier has to make contact with the toner, which speeds up the charging of the toner. On the other hand, the smaller grains of carrier may cause the so-called carrier phenomenon or the carrier to be attached on the photosensitive body. Hence, the average diameter of the carrier is preferably about 30 to 100 μm.

The carrier can be used in a broken-up or sorted state, and the carrier may also be covered with an appropriate resin. As resin, for example, florida resin, styrene resin, acryl resin, silicone resin, epoxy resin, polyester resin and polyalkylene resin are used alone or mixed with other resins to cover the surface of the carrier.

The magnetic toner of the present embodiment is preferably composed of binding resin, magnetic powder, mold lubricant and a charge control agent.

For the binding resin, polystyrene, polyacrylate, polymethacrylate, vinyl resin, polyester resin, polypropylene, polyvinyl chloride, polyacrylonitrile, polyether, polycarbonate, cellulose resin, polyamide, and a copolymer of any of the above may preferably be used. A copolymer made of a styrene monomer or acryl monomer is most preferred.

As the magnetic powder, any material can be used as long as it displays magnetic characteristics or it can be magnetized, and minute powder of metals such as iron, manganese, nickel, cobalt, and chrome, or minute powder of metal oxide such as magnetite, hematite and ferrite may be used. By "minute" powder is menat powder having an average diameter in the range of about 0.1 μm to about 0.5 μm.

As a mold lubricant, any material made from mixing polyalkylene or a natural wax can be used, such as polyethylene, polypropylene, carnauba wax, candelilla wax or rice wax.

As examples of charge control agents, nigrosine dye, grade-4 ammonium salt, alkylamineoxide, alkylamide, metallic foil of azo dyes, and metallic salt of high grade fatty acid may be named.

The ratio of the components to be mixed to form the toner will now be described. The amount of magnetic powder should preferably be 35–55% in terms of the weight of the toner. If the magnetic powder content exceeds 55%, the magnetic binding power for the sleeve 28 side may become too strong and an image with sufficient concentration may not be obtained unless the number of rotations of the sleeve and the gap between the sleeve 28 and the photosensitive body 10 is strictly adjusted, while if the magnetic powder content of the toner becomes less than 35%, sufficient magnetic binding power for the sleeve 28 may not be obtained and a problem may possibly occur in which uncharged toner attaches onto the photosensitive body 10 as fog. Moreover, the ratio of the mold lubricant in general should preferably be about 0.5–10% in weight and the ratio of the charge control agent should preferably be about 0.1–5.0% in weight, with the remainder composing the binding resin.

The average granule diameter of the toner is preferably selected to be in the range of 5–15 μm. In other words, if the granule diameter is less than 5 μm, it may become difficult to treat the toner as a powder, fluidity of the may toner decrease and uniform frictional charging may become difficult. On the other hand, if the average granule diameter of the toner exceeds 15 μm, resolution of developed image may worsen and it may become difficult to obtain a resolution of 300 dpi, which is an average resolution for most of the current printers.

Furthermore, with the electrostatic latent image developing agent 30 of the present invention, silica, whose BET-relative surface area is preferably in the range of 50–300 $m^2/g$, and inorganic minute powder, for example powder having an average diameter in the range of about 0.1 μm to about 0.5 μm, are added as external additives.

The silica is ideal to add fluidity to the toner and the surface of silica may preferably be treated with silicon having a silyl radical such as aminosilane, trimethylsilane, dimethylsilane and octylsilane. The silica which is surface treated with such surface treatment agents is effective as a stabilizer when atmospheric conditions such as temperature and humidity change. The silica displays an effect such as fluidity by attaching onto the toner surface. In other words, by attaching onto the toner surface, silica acts as a roller and prevents direct contact between the toner particles, reducing the stress applied to the toner by contact and friction. However, if the relative surface area of the silica is less than 50 $m^2/g$, the dispersion among the toner may become too little to cause the attachment of the silica onto the toner surface, failing to create fluidity.

On the other hand, if the silica has a relative surface area greater than 300 $m^2/g$, the silica may not act as a roller, as explained above. This is because if silica with a large relative surface area is used, many layers of silica may need to be attached onto the toner surface to prevent contact between the toner particles. However, when many layers of silica are attached onto the toner surface, silica ceases to function as a roller and the effect of using the silica becomes insignificant.

Moreover, the shape of the silica particle is preferably spherical. This is because if the shape of silica particle is undefined, the effect of silica as a roller between the toner particle may weaken.

The inorganic minute powder mentioned above can be either oxide or non-oxide powder, and minute particles aimed to resolve poor cleaning and minute particles aimed to resolve the missing middle may preferably be added as an external additive.

In order to resolve the problem of poor cleaning, minute particles of so-called abrasive powder are very effective and some examples of abrasive powders include silicon carbide, alumina, titanium dioxide, zinc oxide and silica.

The toner developed on the photosensitive body 10 is transferred by the transfer equipment 20 to the recording medium 18, but not all the toner on the photosensitive body 10 are transferred to the recording medium 18, and some toner remains on the photosensitive body 10. Hence, it becomes necessary to clean the surface of the photosensitive body 10 by scraping the residue toner from the surface with a cleaning blade 22.

The cleaning blade 22 is pushed against the surface of the photosensitive body 10, hence, particles down to the diameter of 1 μm may be scraped off by the cleaning blade 22, but particles with less than 1 μm diameter cannot be removed by the cleaning blade 22. The toner which is not removed is pushed against and attached to the photosensitive body 10 by the cleaning blade 22. Once the toner is attached to the photosensitive body 10, the toner keeps growing since additional toner attaches to toner already attached, resulting in large black spots on the image formed on the recording medium 18, which become even larger and damages the image quality as printing continues.

The abrasive agent in the form of inorganic powder which composes the electrostatic latent image developing agent 30 in the present embodiment plays the role of scraping the toner attached on the photosensitive body 10 before the toner grows larger. Here, particles such as the above-mentioned silica having a relative surface area may act as an abrasive agent, but silica alone would not produce a satisfactory result. By mixing small, hard particles with a BET-relative surface area of preferably less than 50 $m^2/g$, such as silicon carbide, alumina, titanium dioxide, zinc oxide, and silica, worsening of the image quality caused by the poor cleaning described above may be prevented.

In order to resolve the problem of the missing middle, metallic soap, titanium dioxide, strontium oxide, and/or strontium titanic acid, for example, is preferably added to the toner as a missing-middle-prevention agent. Minute powder of zinc stearate is preferably used as the metallic soap. The amount of the minute zinc stearate powder to be added to the initial toner is preferably no more than 0.5% in terms of the weight of the toner.

The missing middle problem is caused by part of the toner not being transferred but remaining on the surface of the photosensitive body 10 when the toner developed on the photosensitive body 10 is transferred to the recording medium 18 by the transfer equipment 20. Such a missing middle problem varies depending on the pressure of the transfer roller used as the transfer equipment on the photosensitive body 10, its feeding speed, or transfer current of the transfer roller. However, some types of recording medium 18 are found to cause no missing middle problem. In particular, the thickness of the paper has a major effect on the occurrence of the missing middle, for example, the missing middle problem may not occur with the 20 lb 4024 paper produced by Xerox Corp. but may occur with the 28 lb 4024 paper, also produced by Xerox Corp.

In order to overcome the problem of the missing middle, metallic soap, for example, is used as a missing-middle-prevention agent, which attaches onto the surface of the photosensitive body 10 and acts as an aggregate to improve mold separability of the toner from the photosensitivity body 10, resulting in improved efficiency in the transfer of the toner from the photosensitive body 10 to the recording medium 18. However, as explained in the background section above, mixing of the metallic soap with the toner causes an increase in the amount of toner charge and the spread of toner charge distribution, resulting in increased toner with reverse polarity, which in turn causes the attachment of toner onto the part of the photosensitive body 10 where an electrostatic latent image does not exist. This attached toner is transferred to the recording medium 18, causing increased fogging due to unnecessary toner on the recording medium 18. Hence, the use of metallic soap needs to be controlled strictly in order to prevent fogging.

By using minute powder of zinc stearate as the missing-middle-prevention agent and by holding the amount of the zinc stearate preferably to no more than 0.5% in terms of the weight of the toner, and by not adding zinc stearate to the replacement toner, the effect of fog printing prevention is further strengthened.

In the case when titanium dioxide is used as a missing-middle-prevention agent, use of titanium dioxide alone may prevent missing middle, but the treatment of a titanium dioxide surface with silicon oil, zinc stearate, silane coupling agent or the like produces mold separability between the photosensitive body 10 and the toner, making titanium dioxide ideal for the prevention of missing middle. In particular, use of surface treated titanium dioxide with more than a 5% hydrophobic rate, for example, is most effective and the use of silicon oil as a surface treatment agent yields a most effective result.

The amount of silicon oil or other surface treatment agent is preferably between 1–50% of the total surface area of the titanium dioxide. If the amount of the surface treatment agent is less than 1%, mold separability of the toner from the photosensitive body 10 may not be realized while if the amount of the surface treatment agent is more than 50%, the characteristics of silicon oil may appear too much and the powder characteristics of titanium dioxide may be lost, possibly causing an uneven distribution of the titanium dioxide around the toner.

The toner for replacement use for the laser beam printer of the present embodiment contains each material described above except for the missing-middle-prevention agent.

Embodiments of the invention, including the electrostatic latent image agent 30 and replacement toner 40, are described further by way of the following examples. A laser beam printer is used in each of the examples.

EXAMPLE 1

Styrene acryl resin (Sanyo Chemical Industries, Ltd, UN13C00), 100 parts by weight, magnetite (Toda Kogyo Corp., MAT305), 70 parts by weight, and charge control agent (Orient Chemical Co. Nigrosine dye N-01), 4 parts by weight, are mixed in powder form. Magnetite and a charge control agent are spread in the resin while heating the mixture with a kneading extruder. After cooling the heat kneaded material, the material is made into minute particles on the order of several μm by rough crushing, followed by a minute crushing operation. Then a wind power sorter is used to obtain powder toner particles with an average particle diameter of about 3–20 μm.

Then, toner to be filled in the laser beam printer as the original developing agent is produced by adding to 100 parts by weight of the toner particles described above, one weight part of hydrophobic silica minute powder (particle diameter:

10–20 nm), (Nippon Aerosil Co., HVK2150), 0.5 parts by weight of silicon carbide powder (relative weight 5 g/cm$^3$) (Fujimi Kenma KK, WA#4000), and 0.3 parts by weight of zinc stearate powder (Sakai Chemical Industry Co., SZ-DFF), which are mixed with a Henschel mixer to obtain dry toner.

Then, to 10 parts by weight of this dry toner, 50 parts by weight of a carrier comprising a magnetite core coated with a silicone resin, the ratio by weight of magnetite to silicone resin being approximately 1.0:0.5, is mixed to obtain an electrostatic latent image developing agent 30 to be used to fill in the laser beam printer originally. The electrostatic latent image developing agent 30 is filled in the carrier sealing chamber 32 of the developing apparatus 16 and 500 images are initially output. Then, 1,000 images are output by filling 150 g of replacement toner 40 in the toner cartridge 50. For the output image, the image is developed using the charger 12, the laser scanner 14 and the developing apparatus 16 on the photosensitive body 10, after which the toner is transferred to the recording medium 18 by the transfer equipment 20 comprising a transfer roller and the toner is fixed on the recording medium 18 by means of a heat fixing roller.

Here, the replacement toner 40 to be filled in the toner cartridge 50 is produced by adding to 100 parts by weight of the toner particle, one parts by weight of hydrophobic silica minute powder (particle diameter: 10–20 nm), (Nippon Aerosil Co., HVK2150), and 0.5 parts by weight of silicon carbide powder (relative weight 5 g/cm$^3$) (Fujimi Kenma KK, WA#4000), which are mixed with a Henschel mixer.

Using this toner and thick papers (Xerox Corp. 4024 28 lb paper), printing is performed continuously to obtain image samples with no missing middle and no increase in fog as follows:

* 500 page printing: fog 1.8, no missing middle;
* 1000 page printing after toner replacement: fog 1.2, no missing middle.

This result indicates that the missing middle prevention function of the zinc stearate contained in the toner composing the initial electrostatic latent image developing agent 30 which is filled in the laser printer beforehand is maintained and that an increase in fog is prevented by not adding zinc stearate in the replacement toner 40, thus preventing reverse polar charging of the toner. Thus, extremely high quality images are obtained.

The measurement of fog is performed according to the procedure 1–3 below.

1. The degree of whiteness is measured on the paper without printing using a Suga testing calorimeter (Multi Spectro Colour Meter, manufactured by Suga Test Instruments Co. Ltd.).
2. The degree of whiteness is measured and compared between sample papers from the initial 500 page printing using the electrostatic latent image developing agent 30 which is filled beforehand and sample papers from the 1000 page printing supplying replacement toner 40 by the toner cartridge 50.
3. The fog index is obtained by obtaining the difference between the degree of whiteness of each sample measured in 2 and the degree of whiteness of the paper without printing measured in 1.

In other words, it is determined that the smaller the number obtained in 3, the less is the amount of fog and the better the image quality.

Next, the results of experiments in which the composition of the toner composing the electrostatic latent image developing agent 30 to be filled initially in the developing apparatus 16 and the composition of the replacement toner 40 to be filled in the toner cartridge 50 are changed from the composition of the experiment 1 above are summarized in the comparative examples below.

COMPARATIVE EXAMPLE 1

The toner to be filled in the laser beam printer as an original developing agent is produced by adding to 100 parts by weight of the toner particles one part by weight of hydrophobic silica minute powder (particle diameter: 10–20 nm), (Nippon Aerosil Co., HVK2150), 0.5 parts by weight of silicon carbide powder (relative weight 5 g/cm$^3$) (Fujimi Kenma KK, WA#4000), and 0.3 parts by weight of zinc stearate powder (Sakai Chemical Industry Co., SZ-DFF), which is mixed with a Henschel mixer to obtain dry toner.

Then, to 10 parts by weight of this dry toner, 50 parts by weight of the carrier of Example 1 is mixed to obtain the electrostatic latent image developing agent 30 to be used to initially fill the laser beam printer. The electrostatic latent image developing agent 30 is filled in the carrier sealing chamber 32 of the developing apparatus 16 and 500 initial images are output. Then, 1,000 images are output by filling 150 g of replacement toner 40 in the toner cartridge 50. For the output image, the image is developed using the charger 12, the laser scanner 14 and the developing apparatus 16 on the photosensitive body 10, after which the toner is transferred to the recording medium 18 by the transfer equipment 20 comprising a transfer roller and the toner is fixed on the recording medium 18 by means of the heat fixing roller.

Here, the replacement toner 40 to be filled in the toner cartridge 50 is produced by adding to 100 parts by weight of the toner particle, one weight part of hydrophobic silica minute powder (particle diameter: 10–20 nm), (Nippon Aerosil Co., HVK2150), 0.5 parts by weight of silicon carbide powder (relative weight 5 g/cm$^3$) (Fujimi Kenma KK, WA#4000), and 0.3 parts by weight zinc stearate powder (Sakai Chemical Industry Co., SZ-DFF), which are mixed with a Henschel mixer.

Using this toner and thick papers (Xerox Corp. 4024 28 lb paper), printing is performed continuously to obtain image samples as follows:

* 500 page printing: fog 1.8, no missing middle;
* 1000 page printing after toner replacement: fog 3.5, no missing middle.

In comparative example 1, zinc stearate is added to the replacement toner 40. Missing middle prevention effect is sufficient, but on the other hand, charge amount for reverse polarity of the toner caused by zinc stearate increased with the supply of toner, resulting in an increase in fog and poor image quality after toner replacement.

COMPARATIVE EXAMPLE 2

As in the case of comparative example 1, the toner to be filled in the laser beam printer as the original developing agent is produced by adding to 100 parts by weight of the toner particles one part by weight of hydrophobic silica minute powder (particle diameter: 10–20 nm), (Nippon Aerosil Co., HVK2150), 0.5 parts by weight of silicon carbide powder (relative weight 5 g/cm$^3$) (Fujimi Kenma KK, WA#4000), and 0.6 weight parts of zinc stearate powder (Sakai Chemical Industry Co., SZ-DFF), which is mixed with a Henschel mixer to obtain dry toner.

Then, to 10 parts by weight of this dry toner, 50 parts by weight of the carrier of Example 1 is mixed to obtain electrostatic latent image developing agent 30 used to fill the laser beam printer originally. The electrostatic latent image developing agent 30 is filled in the carrier sealing chamber 32 of the developing apparatus 16 and 500 initial images are output. Then, 1,000 images are output by filling 150 g of replacement toner 40 in the toner cartridge 50. For the output image, the image is developed using the charger 12, the laser scanner 14 and the developing apparatus 16 on the photosensitive body 10, after which the toner is transferred to the recording medium 18 by the transfer equipment 20 comprising a transfer roller and the toner is fixed on the recording medium 18 by the heat fixing roller.

Here, the replacement toner 40 to be filled in the toner cartridge 50 is produced by adding to 100 parts by weight of the toner particle one weight part of hydrophobic silica minute powder (particle diameter: 10–20 nm), (Nippon Aerosil Co., HVK2150), and 0.5 parts by weight of silicon carbide powder (relative weight 5 g/cm$^3$) (Fujimi Kenma KK, WA#4000), which are mixed with a Henschel mixer.

Using this toner and thick papers (Xerox Corp. 4024 28 lb paper), printing is performed continuously to obtain image samples as follows:

* 500 page printing: fog 2.7, no missing middle;
* 1000 page printing after toner replacement: fog 2.0, no missing middle.

In comparative example 2, the amount of zinc stearate added to the toner composing the electrostatic latent image developing agent 30 to be initially filled in the laser printer is too great. Thus, the level of fog is high from the beginning of the continuous printing, yielding unsatisfactory image quality.

According to a study by the applicant, if the amount of zinc stearate to be added in the initial developing agent is, for example, less than about 0.5 parts by weight to 100 parts by weight of the toner, image with favorable image quality may be obtained.

In the above experimental examples, minute powder of zinc stearate powder is added to the toner to prevent missing middle problem, but other missing middle prevention agents such as titanium dioxide, strontium oxide, strontium titanic acid or the like may be used as well.

What is claimed is:

1. An electrostatic latent image developing method using an electrostatic latent image developing apparatus to develop an electrostatic latent image, comprising providing the electrostatic latent image apparatus with an initial developing agent comprising at least one carrier and toner containing at least one missing-middle-prevention agent, forming an electrostatic latent image on a photosensitive body of the developing apparatus, developing the electrostatic latent image on the photosensitive body by contacting the electrostatic latent image with the developing agent to produce a developed toner image, transferring the developed toner image formed on the photosensitive body to a recording medium, fixing the developed toner image to the recording medium, and supplying replacement toner to compensate for the toner consumed from the initial developing agent in developing the electrostatic latent image, wherein the replacement toner does not contain missing-middle-prevention agent.

2. The electrostatic latent image developing method as claimed in claim 1, wherein said missing-middle-prevention agent of the toner in the initial developing agent is at least one of metallic soap, titanium dioxide, strontium titanic acid and strontium oxide.

3. The electrostatic latent image developing method as claimed in claim 2, wherein said metallic soap is zinc stearate powder.

4. The electrostatic latent image developing method as claimed in claim 3, wherein the amount of zinc stearate powder added to the toner in the initial developing agent is no more than 0.5% by weight of the toner.

5. The electrostatic latent image developing method as claimed in claim 1, wherein the amount of missing-middle-prevention agent added to the toner in the initial developing agent is no more than 0.5% by weight of the toner.

6. The electrostatic latent image developing method as claimed in claim 1, wherein the replacement toner is supplied at a rate corresponding to the rate of consumption of toner from the initial developing agent.

7. The electrostatic latent image developing method as claimed in claim 1, wherein said forming includes providing surface potential to a surface of the photosensitive body.

8. The electrostatic latent image developing method as claimed in claim 1, wherein said transferring is directly from said photosensitive body to said recording medium.

9. The electrostatic latent image developing method as claimed in claim 1, wherein following said transferring, toner which is not transferred but remains on the photosensitive body is removed.

10. A method for producing an image on a recording medium having reduced fogging and substantially free of missing middle, comprising providing an initial developing agent comprising at least one carrier and toner containing at least one missing-middle-prevention agent, developing an electrostatic latent image with the initial developing agent to produce a developed toner image, transferring and fixing the developed toner image formed to a recording medium, supplying replacement toner to compensate for the toner consumed from the initial developing agent in developing the electrostatic latent image, wherein the replacement toner does not contain missing-middle-prevention agent, and repeating said developing, transferring and fixing.

* * * * *